US011945672B2

(12) United States Patent
Leeper

(10) Patent No.: US 11,945,672 B2
(45) Date of Patent: Apr. 2, 2024

(54) SINGLE ITEM REMOVAL

(71) Applicant: NCR Corporation, Atlanta, GA (US)

(72) Inventor: Kevin Leeper, Angus (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 17/530,851

(22) Filed: Nov. 19, 2021

(65) Prior Publication Data

US 2022/0073298 A1 Mar. 10, 2022

Related U.S. Application Data

(63) Continuation of application No. 13/285,854, filed on Oct. 31, 2011, now Pat. No. 11,220,409.

(51) Int. Cl.
*B65H 3/62* (2006.01)
*B65H 3/08* (2006.01)

(52) U.S. Cl.
CPC ..... *B65H 3/62* (2013.01); *B65H 3/0808* (2013.01); *B65H 2301/321* (2013.01); *B65H 2301/42342* (2013.01); *B65H 2403/514* (2013.01); *B65H 2701/1912* (2013.01)

(58) Field of Classification Search
CPC .. B65H 3/62; B65H 3/0808; B65H 2301/321; B65H 2301/42342; B65H 2403/514; B65H 2701/1912
USPC ..... 221/211; 271/104
See application file for complete search history.

(56) References Cited

U.S. PATENT DOCUMENTS 2,224,802 A * 12/1940 Spless ..... B65H 3/0825 271/103
4,653,742 A * 3/1987 Sasaki ..... B65H 3/063 271/166
4,709,914 A * 12/1987 Taylor ..... G07D 11/22 271/263
4,768,770 A * 9/1988 Pessina ..... B65H 3/0808 271/107
5,100,121 A * 3/1992 Takei ..... B65H 3/34 271/104
5,181,707 A * 1/1993 Takei ..... B65H 3/0833 271/106
5,256,022 A * 10/1993 Neudecker ..... G03B 42/045 271/107
5,328,165 A * 7/1994 Martin ..... B65H 3/48 271/98
5,350,166 A * 9/1994 Shimizu ..... B65H 3/0833 271/106
5,876,031 A * 3/1999 Ohkoda ..... B65H 3/0833 271/902
5,921,540 A * 7/1999 Acquaviva ..... B65H 3/48 271/104

(Continued)

FOREIGN PATENT DOCUMENTS

EP 841642 A2 * 5/1998 ..... B65H 5/00

*Primary Examiner* — Rakesh Kumar
(74) *Attorney, Agent, or Firm* — Schwegman Lundberg & Woessner, P.A.

(57) ABSTRACT

A method and apparatus are disclosed for removing one item of media at a time from an item of media container. The apparatus includes a movable element locatable in an abutting relationship with an elected item of media in a media container and disposed to vibrating against the elected item of media to permit the elected item of media to be subsequently be removed alone from the container.

7 Claims, 5 Drawing Sheets

(56) References Cited

U.S. PATENT DOCUMENTS 6,015,145 A * 1/2000 Hartel ..... B65H 3/48 271/106
7,363,753 B2 * 4/2008 Gates ..... B65B 43/18 53/469
7,870,997 B2 * 1/2011 Eastman ..... G07F 19/202 902/8
8,267,399 B2 * 9/2012 Kushida ..... G03G 15/6538 271/81
8,336,870 B2 * 12/2012 Kobayashi ..... B65H 7/02 271/96
10,114,322 B2 * 10/2018 Hasegawa ..... G03G 15/2025
2004/0065221 A1 * 4/2004 Takeda ..... B65H 1/14 101/477
2006/0285871 A1 * 12/2006 Kato ..... G03G 15/168 399/99
2007/0029718 A1 * 2/2007 Giese ..... B65H 3/46 271/90
2008/0124143 A1 * 5/2008 Shinkawa ..... G03G 15/2028 399/327
2009/0232998 A1 * 9/2009 Krebs ..... B05C 1/083 427/428.2
2009/0244148 A1 * 10/2009 Mitsuhashi ..... B41J 2/16585 347/14
2010/0025515 A1 * 2/2010 Gelli ..... B65H 19/29 242/532.3
2010/0327518 A1 * 12/2010 Tharayil ..... B65H 7/10 271/226
2011/0133392 A1 * 6/2011 Kushida ..... B65H 31/36 271/145
2013/0105505 A1 * 5/2013 Leeper ..... B65H 3/62 700/232
2013/0240556 A1 * 9/2013 Yamada ..... A47K 10/421 221/63

* cited by examiner

SINGLE ITEM REMOVAL

CROSS-REFERENCE TO RELATED APPLICATION

This application is a continuation of U.S. application Ser. No. 13/285,854, filed on Oct. 31, 2011, which application and publication is incorporated herein by reference in its entirety.

FIELD OF THE INVENTION

The present invention relates to a method and apparatus for removing one item of media at a time from an item of media container. In particular, but not exclusively, the present invention relates to apparatus which can generate a separating effect between an elected item that is to be removed from a container and a next item of media in the container to thereby permit the elected item of media to be removed alone from the container.

BACKGROUND TO THE INVENTION

It is known that various types of container can be used to contain items of media. For example, a cassette or depository can be utilized to store flexible items of media such as, but not limited to, currency notes, checks, tickets, giros and the like.

Such media containers are often used in self-service terminals such as automatic teller machines (ATMs), vending machines, change machines and the Ike.

In such machines, it is important that when an item of media is to be removed from the container in which it is held, the item of media is removed without error. A particular problem with such removal is that it is often difficult to remove one item of media from a pick up region of a container without upsetting the next item of media within the container or without risking the removal of multiple items together.

Certain solutions to this problem have been suggested, however, often these require separate parts to be provided in or close to the container and these must be moved from time to time and often utilize excessive force during a pick up sequence. The provision of such extra parts is costly, prone to error and can itself lead to further aggravating problems which can cause failure of the removal process.

SUMMARY OF THE INVENTION

It is an aim of the present invention to at least partly mitigate the above-mentioned problems. It is an aim of certain embodiments of the present invention to provide an apparatus for removing one item of media at a time from an item of media container.

It is an aim of certain embodiments of the present invention to provide a method and apparatus which enables items of media to be removed alone without any additional parts being needed in the service terminal.

According to a first aspect of the present invention there is provided apparatus for removing one item of media at a time from an item of media container, the apparatus comprising:

a movable element locatable in an abutting relationship with an elected item of media in a media container and disposed to vibrate against said elected item of media to permit said elected item of media to be subsequently removed alone from the container.

Aptly, the movable element vibrates against an outer surface of the elected item at a frequency of about around 50 to 150 Hz responsive to repeated counter rotationary motion of a carrier of said movable element.

Aptly, the movable element comprises a region of a pick up lever.

Aptly, the movable element is locatable responsive to a driver signal.

Aptly, the drive signal comprises a stepper motor pick line drive signal.

Aptly, in a release mode of operation, a carrier of said movable element is repeatedly rotatable in a clockwise and anti-clockwise motion about an axis of rotation on each side of a resting position, said movable element being located off centre on the carrier whereby repeated counter rotation of the carrier induces an effective backwards and forwards motion of the movable element against the elected item of media.

Aptly, in a pick mode of operation, immediately subsequent to said release mode of operation, said carrier of the movable element is rotated about the axis of rotation responsive to a non-idle pick line drive signal to thereby urge a suction element carried by the movable element against an outer surface of said elected item of media.

Aptly, the region of the pick up lever comprises a low friction surface region.

Aptly, the apparatus comprises an automated teller machine (ATM), the item of media comprises a currency note and the container comprises a currency cassette.

According to a second aspect of the present invention there is provided a method of removing one item of media at a time from an item of media container, the method comprising the steps of:

prior to a pick mode of operation in which an elected item of media is removed alone from an item of media container, vibrating a movable element arranged to abut the elected item of media against an outer surface of the elected item of media, to thereby separate said elected item of media from a next item of media in the container.

Aptly, the method step of vibrating the movable element comprises the steps of repeatedly rotating a carrier of the movable element in a clockwise and anti-clockwise motion about an axis of rotation on each side of a resting position, and inducing an effective backwards and forwards motion of the movable element located off centre on the carrier, responsive to the repeated rotation.

Aptly, the method further comprises the steps of:

in the pick mode of operation immediately subsequent to a release mode of operation, providing a non-idle pick line drive signal;

rotating a carrier of the movable element about an axis of rotation responsive to the non-idle pick line drive signal;

urging a suction element carried by the movable element against the elected item of media;

energizing a negative pressure source connected to the suction element to thereby releasably secure the item of media to the suction element; and removing the item of media from the item of media container by rotating the carrier of the movable element about the axis of rotation into a feed location, a portion of said item of media being carried with the movable element.

According to a third aspect of the present invention there is provided a product which comprises a computer program comprising program instructions for:

prior to a pick mode of operation in which an elected item of media is removed alone from an item of media container, vibrating a movable element arranged to abut the elected item of media against an outer surface of the elected item of media, to thereby separate said elected item of media from a next item of media in the container.

Certain embodiments of the present invention provide the advantage that a movable pick up lever can be utilized to provide a separating effect between an elected item of media and a next item of media to be removed in a container. This helps permit the elected media to be subsequently removed from the container alone, as it minimizes the chance that other items of media will be removed from the container with the picked item of media.

Certain embodiments of the present invention provide the advantage that a movable pick up lever, normally utilized to pick items of media from the container, can have a double function. Notably, an end of the lever can be made to abut an outermost item of media at a pick up region of the container and this part of the lever can be made to vibrate against the items media in the container immediately prior to a step in which the outermost elected item of media is picked and removed from the container. By continually knocking against the elected item of media which is to be picked, other items of media in the container become detached from the item being picked.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
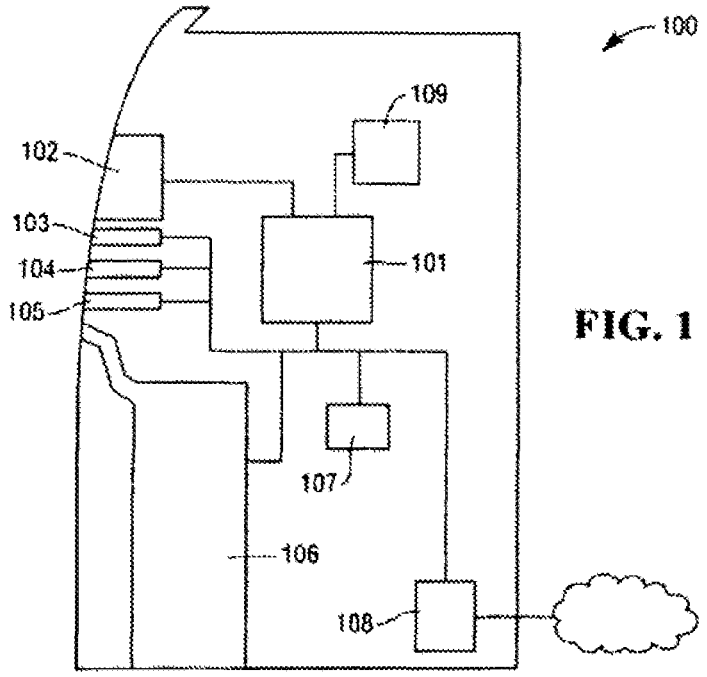
FIG. 1 illustrates a schematic diagram of a self-service terminal such as an ATM.

In the drawings like reference numerals refer to like parts.

FIG. 1 illustrates a block diagram of a self-service terminal 100 in the form of an automated teller machine (ATM) according to one embodiment of the present invention. It will be understood that certain embodiments of the present invention are applicable to other types of terminal such as ATMs, vending machines, change machines and the like.

The ATM 100 includes different modules for enabling transactions to be executed and recorded by the ATM 100. These ATM modules include customer transaction modules and service personnel modules. The ATM modules include an ATM controller 101, a customer display 102, a card reader/writer module 103, an encrypting keypad module 104, a receipt printer module 105, a cash dispenser module 106, a journal printer module 107 for creating a record of every transaction executed by the ATM, a connection module 108, an operator panel module 109 for use by a service operator (such as a field engineer, a replenisher (of currency, of printed paper or the like), or the like).

Certain customer transaction modules (such as the ATM controller 101) are also used by the service personnel for implementing management functions. However, some of the modules are referred to herein as service personnel modules (such (such as the journal printer module 107 and the operator panel module 109) because they are never used by ATM customers.

Figure 2:
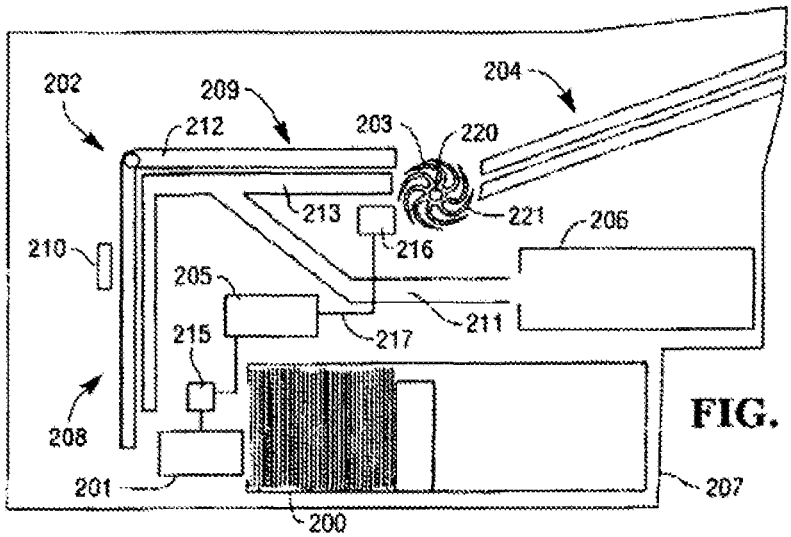
FIG. 2 illustrates a schematic diagram of a media dispenser such as a currency note dispenser.

FIG. 2 illustrates a schematic diagram of an ATM media dispenser 100. The ATM 100 includes a removable currency cassette 200, a pick unit 201 which operates to remove individual bank notes from the currency cassette 200, a transport section 202 for transporting picked bank notes, a stacker wheel 203 (instead of a stacker wheel a ballistic stacker or a spray dispenser or the like could be used). A presenter unit 204 presents a bunch of picked and collated bank notes to a customer. A controller 205 controls the operation of the dispenser 100 and a purge bin 206 stores incorrectly picked bank notes or bank notes not removed by a customer. These component parts are housed within a chassis 207.

The transport section 202 includes a vertical portion 208 for receiving a picked bank note from the pick unit 201 and a horizontal portion 209 for conveying a picked bank note either to the stacker wheel 203 or the purge bin 206. The vertical portion 208 includes a conventional bank note thickness sensor 210 to detect multiple superimposed bank notes being transported erroneously as a single bank note. Any such superimposed bank notes may have to be diverted to the purge bin 206 via a divert path 211. The horizontal portion 209 comprises an upper guide 212 which is pivotably coupled to a lower guide 213 to permit access to any bank notes jammed therebetween so that the jammed bank note can be removed therefrom. The lower guide 213 includes a diverter (not shown) for routing a bank note (or multiple bank notes) to the divert path 211.

The transport section includes various belts and/or gears to transport bank notes or other such currency notes and these belts and/or gears are all powered by a pick motor 215. The stacker wheel 203 is coupled to a stacker wheel motor 216.

The stacker wheel motor 216 is coupled to the controller 205 by a control line 217.

The stacker wheel 203 comprises an axle 220 on which are mounted a plurality of mutually coupled but axially separated hubs (only one of which is shown in FIG. 2). Each hub includes a plurality of arcuate tines 221 disposed transverse to the axle on which the hubs are mounted. The hubs are mounted in registration so that the arcuate tines on one hub are aligned with the corresponding arcuate tines on all other hubs.

The hubs are rotated in unison as bank notes are fed towards the stacker wheel from the transport section. The rotation of the stacker wheel is synchronized with the speed at which bank notes are conveyed so that only one bank note is stored between adjacent tines on a hub.

Figure 3:
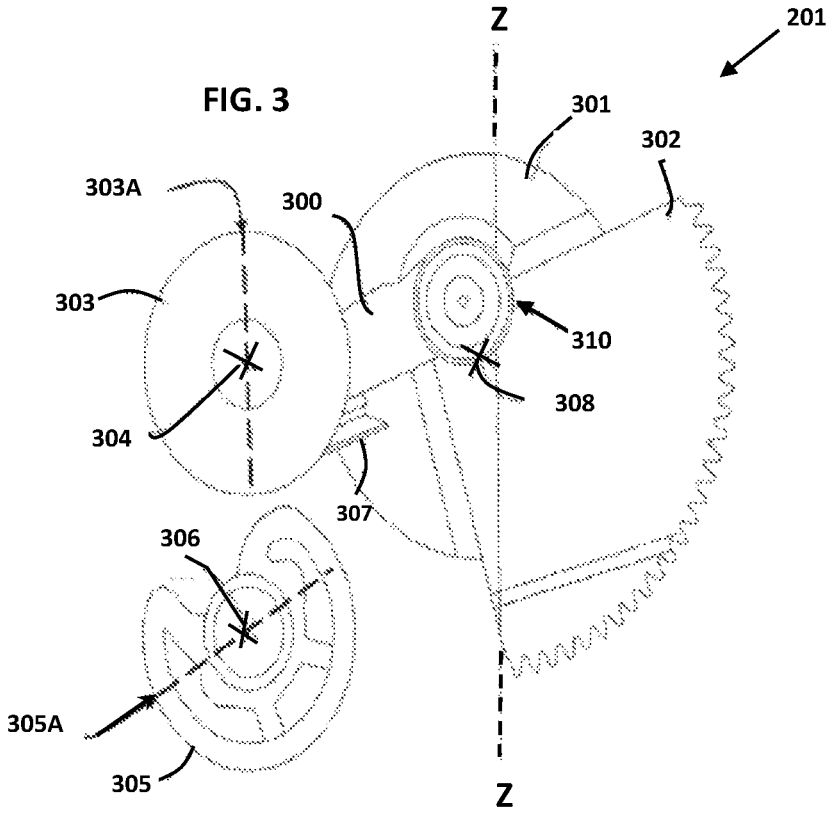
FIG. 3 illustrates a pick up arm beginning a pick mode of operation.

FIG. 3 illustrates a pick up arm 300 which is supported by a pick arm carrier 301. A pick arm gear 302 moves with the pick arm and carrier 301. A first upper roller 303 rotates about a respective axis of rotation 304 and a lower roller 305 rotates about a respective further axis of rotation 306.

The opposed nip rollers 303, 305, pick arm 300, pick arm carrier 301 and gear 302 form part of the pick unit 201 shown in FIG. 2. The pick arm 300 is an elongate arm which carries at a first end thereof (only partially shown in FIG. 3) a suction cup 307. At a further end region of the pick arm 300 the arm is fixed off centre to the pick arm carrier 301 which rotates with respect to the axis of rotation 308. The arm, carrier and gear may be separate parts connected together as may be integrally formed.

The opposed nip rollers are continually driven. That is to say, the upper nip roller 303 is constantly rotated clockwise whilst the lower nip roller 305 is constantly driven anti-clockwise. The lower nip roller 305 is not a whole roller. The diameters of the nip rollers are different and the speed of rotation is different so as to avoid undue wear on the opposed rollers, That is to say, the complete roller and gap roller both rotate at different speeds and have different diameters but have the same surface speed so that the rollers close at different places on each rotation to avoid undue wear in any one place.

Figure 4:
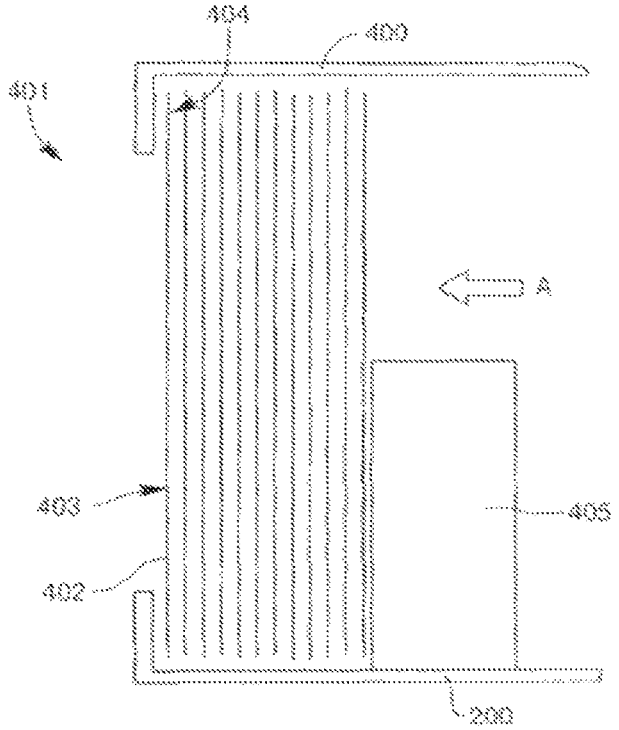
FIG. 4 illustrates a currency note cassette containing currency notes.

In use, the pick arm lever 300 which carries the suction cup 307 is rotated so as to urge the suction cup against an outer surface of an item of media to be picked. FIG. 4 illustrates a portion of a currency cassette 200 which includes an outer secure housing 400 which has an open mouth region 401. Currency notes or other such items of media are stacked within the cassette. An outermost currency note 402 is an elected item of media in the sense that it will be picked in a next picking mode of operation. The elected item of media 402 has an outer surface 403 and an inner surface 404. The inner surface 404 of the elected item of media 402 is in a face-to-face juxtaposed position with an outer surface of a next item of media and so on. A cassette plunger 405 is biased so as to urge any currency notes in the cassette in the direction A shown in FIG. 4. That is to say, towards the open mouth of the currency cassette. This means that the currency notes are constantly moved to present items of media at the opening of the cassette so that the currency cassette can be emptied of currency notes after many pick operations.

FIG. 3 illustrates the configuration of the pick arm and pick carrier at an initiation sequence of a pick mode of operation. The gear 302 is driven by a stepper motor gear so as to rotate all of the gear 302, carrier 301 and pick arm 300 in an anti-clockwise direction about the axis of rotation 308. It is to be noted that in the initial state shown in FIG. 3, an abutment surface region 310 which is an arcuate, partially cylindrical surface region of the end of the pick arm extends beyond a centre line Z-Z. As the gear 302 is driven anti-clockwise about the axis of rotation 308 it will be understood that because the pick arm is mounted off centre with respect to the axis of rotation of the carrier 301, then the pick arm abutment surface 310 will move away from the line Z-Z.

Figure 5:
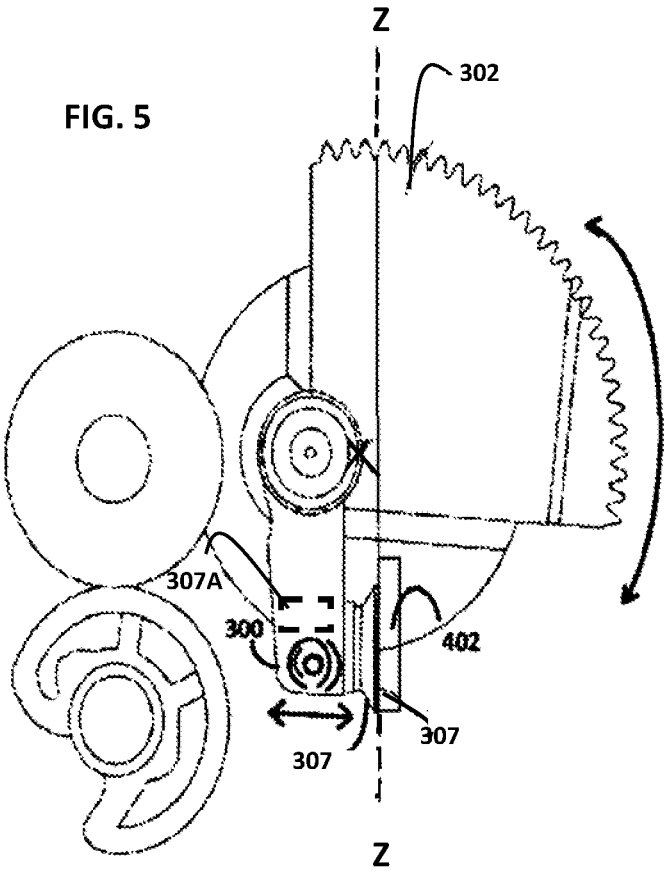
FIG. 5 illustrates a later stage in the pick mode of operation.

FIG. 5 illustrates the location of the pick arm and suction cup 307 in a later state of a pick mode of operation. The gear 302 has been driven anti-clockwise about the axis of rotation 308 which has rotated the pick arm in an anti-clockwise fashion into the position shown in FIG. 5. The currency cassette and any currency notes in the currency cassette are located so that the outer surface 403 of an outermost currency note is aligned along the line Z-Z. Thus, in the position show in FIG. 5, the suction cup 307 becomes engaged with an outer surface 403 with an elected item of media. In fact, the pick arm, gear and carrier may optionally be driven a little further anti-clockwise so as to move the pick arm a little (aptly, one, two or more degrees) into the open mouth of the currency cassette.

In order to pick the currency note, when the suction cup 307 is engaged against an outer surface of a currency note, a vacuum source 307A is initiated and connected into fluid communication with the suction cup 307. If an item of media is present in the currency cassette, the body of the item of media doses an open mouth of the suction cup 307, thus effectively forming a sealed pathway. The negative pressure established in the suction cup 307 enclosure thus causes the outermost elected item of media to "stick" to the pick arm 300. In a next mode of operation, the stepper motor is driven in an opposite direction against the gears 302 which then begins to move the pick arm 300 in a clockwise rotation motion about the axis of rotation of the carrier. Because the currency note is effectively stuck to the suction cup 307 at this stage, the elected item of media begins to move, or at least a region of the currency note where the suction cup 307 is located, begins to move.

Aptly, two brushes (not shown) are positioned approximately ten to fifteen degrees of rotation away from the line Z-Z, If by accident two or more items of media are picked, the brushes cause any items of media which are not engaged with the suction cup to fall away from that elected item of media and they will fall back into the currency cassette.

The rotation of the gear 302 in a clockwise direction about the axis of rotation 308 then continues moving the elected item of currency into a position where an edge region of the elected item of media is presented between the counterrotating rollers. The vacuum source 307A is then terminated and the nip rollers remove the elected and now picked item of media which is then transported to a 15 distribution point.

Figure 6:
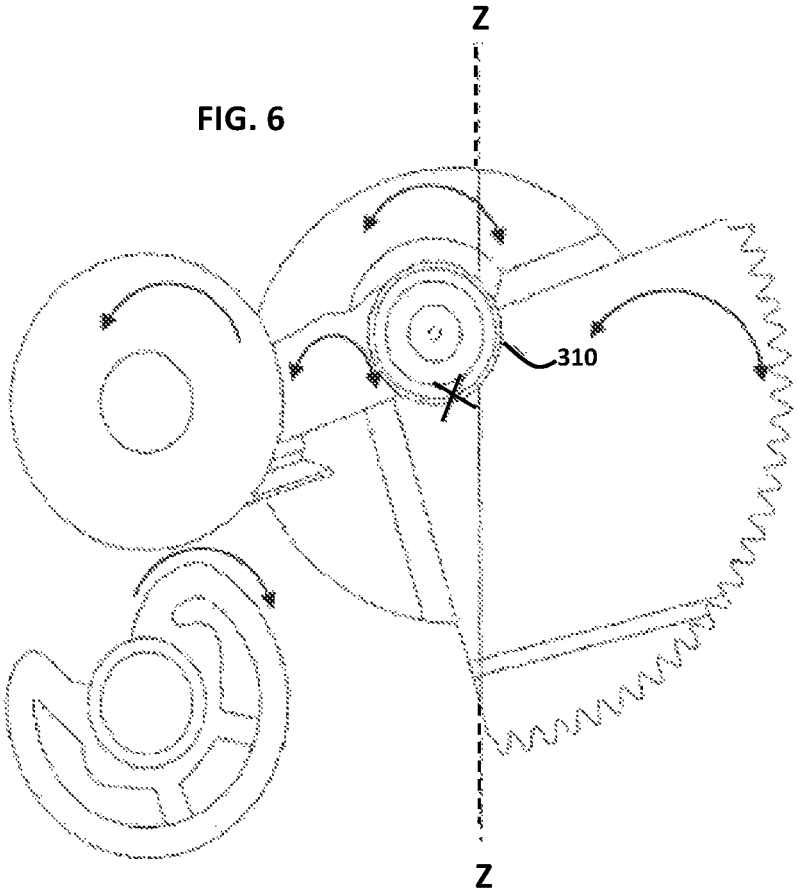
FIG. 6 illustrates a release mode of operation prior to the pick mode of operation.

FIG. 6 illustrates a rebase mode of operation. The release mode of operation is carried out immediately prior to a pick mode of operation. The release mode of operation operates to separate an elected item of media in a container from a next item of media to be picked so that the elected item of media can be picked alone. That is to say, only a single item of media is picked in any one pick step.

As shown in FIG. 6, the abutment surface 310 extends beyond the line Z-Z. In this position, the surface 310 abuts against an outer surface of an elected item of media. By providing a drive signal to a stepper motor which drives the gear 302, and because the pick arm is positioned off centre with respect to an axis of rotation 308 of the carrier by repeatedly driving the gear 302 by a short distance clockwise and then anti-clockwise, the abutment surface 310 can be made to effectively move backwards and forwards against the outer surface of an elected item of media. That is to say, rotatory motion of the gear 302 is translated into an effective vibrating force exerted by the abutment surface 310 against an elected item of media. If the notes are crisp and flat, indicative of newly printed currency notes, then this vibrating force can affect many hundreds of notes in the currency cassette. If the notes are softer and more crumply, indicative of pre-used notes, then the vibration force translates only through the first handful of notes. Aptly, the first two or three notes. This vibratory force causes the currency notes to separate by falling away from one another when the abutment surface 310 pushes the outermost currency note against the biaising force exerted by the cassette pusher 405. That is to say, in a release mode of operation the abutment surface 310 pushes against the direction A shown in FIG. 4. This releases the elected item of media which falls by virtue of gravity away from a next item of media to be picked. During a subsequent pick mode of operation, the elected item of media can thus be picked alone.

Aptly, the vibration caused by the motion of the abutment surface 310 has a frequency of about around 50 to 150 Hz. Aptly, the frequency is 80 to 120 Hz. Aptly, the frequency is 90 to 110 Hz.

The production of a vibrating force that causes an elected currency note to separate from a next currency note is particularly helpful when currency notes or other items of media have a high friction component acting between them. That is to say, when the printing surface decoration, or holographic methodology used to print the item of media means that a relatively rough surface is provided. The separation mode of operation described herein above helps reduce this combined friction and helps ensure that only one item of media is ever picked at any one time.

Whilst certain embodiments of the present invention have been described herein above with reference to the pick up arm lever as being a movable element which can cause a separation force, it will be understood that certain other embodiments of the present invention can utilize a dedicated and separate movable element, for example, a driven roller which is urged against an outer surface of an elected item of media in the container. The pick lever thus plays no part in the release mode of operation but rather is used solely to pick elected items in the pick mode of operation. Drive signals may be provided to this driven roller or other such vibrating movable mechanism prior to the pick mode of operation to separate the elected item of media from a next item of media.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. A method, comprising:

repeatedly rotating an abutment surface of a pick arm lever forward and backward against an elected item of media in a clockwise and anticlockwise motion about an axis of rotation, wherein the pick arm lever is affixed to a carrier and the carrier rotates and performs rotational motion about the axis of rotation;

inducing motion of a first end of the pick arm lever based on the repeatedly rotating against the elected item of media;

separating the elected item of media by activating a vacuum source situated on the first end of the pick arm lever;

terminating the vacuum source releasing the elected item of media to rollers;

rotating the rollers in opposite directions and a different speeds, wherein the rollers comprise an upper nip roller and a lower nip roller, and wherein the lower nip roller is a partial truncated roller that is not a whole roller, wherein rotating the rollers further includes rotating the upper nip roller having a first diameter in clockwise direction at a first speed of rotation while rotating the lower nip roller with a second diameter in an anticlockwise direction at a second speed of rotation, wherein the first speed of rotation is different from the second speed of rotation, and wherein the first diameter is different from the second diameter, and wherein the rollers rotate at different speeds and have different diameters but the rollers have a same surface speed ensuring the rollers close at different places on each rotation to avoid undue wear in any given location.

2. The method of claim 1 further comprising:

operating the method in a pick mode of operation to pick and separate the elected item of media; and operating the method in a release mode of operation to release the elected item of media to the rollers.

3. The method of claim 1, wherein the vacuum source is a suction element.

4. The method of claim 1, wherein repeatedly rotating further includes continuously rotating at a predefined frequency.

5. The method of claim 1 further comprising, operating the method as a component of an Automated Teller Machine (ATM).

6. The method of claim 5 further comprising, operating a gear, the carrier, and the pick arm level as separate parts connected together and combined with the upper nip roller and the lower nip roller to form a pick unit of the ATM, wherein the elected item of media is a currency note.

7. The method of claim 1, wherein repeatedly rotating further includes continuously using a signal to activate a gear that drives the carrier in a first rotational direction and a second rotational direction, wherein the abutment surface of the pick arm lever is affixed at a second end of the pick arm lever off center to the carrier.

* * * * *